US007153056B1

(12) United States Patent
Forrer

(10) Patent No.: US 7,153,056 B1
(45) Date of Patent: Dec. 26, 2006

(54) ROAD MARKER WITH REVERSE CUPS

(75) Inventor: Douglas Forrer, Heath, OH (US)

(73) Assignee: Pac-Tec, Inc., Newark, OH (US)

( * ) Notice: Subject to any disclaimer, the term of this patent is extended or adjusted under 35 U.S.C. 154(b) by 0 days.

(21) Appl. No.: 11/449,205

(22) Filed: Jun. 8, 2006

Related U.S. Application Data

(60) Provisional application No. 60/688,616, filed on Jun. 8, 2005.

(51) Int. Cl.
*E01F 9/06* (2006.01)

(52) U.S. Cl. ..... 404/16

(58) Field of Classification Search ..... 404/9, 404/15, 16; D10/113; 116/63 R
See application file for complete search history.

(56) References Cited

U.S. PATENT DOCUMENTS 1,747,667 A * 2/1930 Foster ..... 404/16
2,579,467 A * 12/1951 Brickman ..... 404/12
5,078,538 A * 1/1992 Montalbano ..... 404/9
5,308,186 A * 5/1994 Hedgewick ..... 404/14
5,667,334 A * 9/1997 Boyce ..... 404/9
6,059,488 A * 5/2000 Green ..... 404/12

* cited by examiner

*Primary Examiner*—Gary S Hartmann
(74) *Attorney, Agent, or Firm*—Gifford, Krass, Groh, Sprinkle, Anderson & Citkowski, P.C.

(57) ABSTRACT

An improved road marker with a one piece shell and recesses containing elongated members with an undercut relief is provided. The road marker contains a retroreflective lens and a bottom surface with a plurality of the recesses protruding into the shell. The cross section of the recesses can be in the shape of a circle, ellipse, triangle or any shaped polygon, and said cross section can vary as a function of the depth of the recess into the shell and the location of said recess on the bottom surface. The cross section of the elongated member in an axial direction can be in the shape of a circle, ellipse, triangle or any shaped polygon. The undercut relief can be in the form of threads, ridges or any type of indentation into the elongated member that provides a rough surface. When the elongated member is permanently attached to the road marker shell, the undercut relief thereon affords increased adherence between the road marker shell and any type of glue or adhesive used to attach the road marker to a road surface.

14 Claims, 2 Drawing Sheets

ROAD MARKER WITH REVERSE CUPS

RELATED APPLICATION

This application claims priority of U.S. Provisional Patent Application Ser. No. 60/688,616 filed Jun. 8, 2005, which is incorporated herein by reference.

FIELD OF THE INVENTION

The present invention in general relates to road markers, and in particular to road markers for the delineation of lanes on roads.

BACKGROUND OF THE INVENTION

Road markers for the delineation of lanes on roads are extensively used. Road markers typically include a plastic shell having a pair of opposed angled retroreflective surfaces. When the light from an oncoming vehicle hits the retroreflective surface, it is reflected in an array of cube corners or fresnel-type lenses to produce a bright reflective appearance on the surface of the marker. This bright surface delineates the lane at night and assists the driver in maintaining proper alignment within a lane.

Typically the road markers that have been produced are a plastic shell which is filled with a potting material to provide strength and weight to the marker. However, the potting process requires additional machinery and the road markers are relatively expensive to produce. Accordingly, there have been a number of attempts to produce a satisfactory solid marker; however, solid markers typically have large vertically extending passages from the bottom which the glue descends to hold the marker down. These markers have not been satisfactory in strength or adhesive to the road. Accordingly, a solid shell unpotted marker has been developed.

SUMMARY OF THE INVENTION

An improved road marker with a one piece shell and recesses containing elongated members with an undercut relief is provided. The road marker contains a retroreflective lens and a bottom surface with a plurality of recesses that protrude into the shell. The cross section of the recesses can be in the shape of a circle, ellipse, triangle or any shaped polygon, and said cross section can vary as a function of the depth of the recess into the shell and location the of said recess on the bottom surface.

Each recess can contain an elongated member, said member having an undercut relief that affords a rough surface. The cross section of the elongated member in an axial direction can be in the shape of a circle, ellipse, triangle or any shaped polygon. The undercut relief can be in the form of threads, ridges or any type of indentation into the elongated member that provides a rough surface. When the elongated member is permanently attached to the road marker shell, the undercut relief thereon affords increased adherence between the road marker shell and any type of glue or adhesive used to attach the road marker to a road surface.

DETAILED DESCRIPTION OF THE INVENTION

Figure 1:
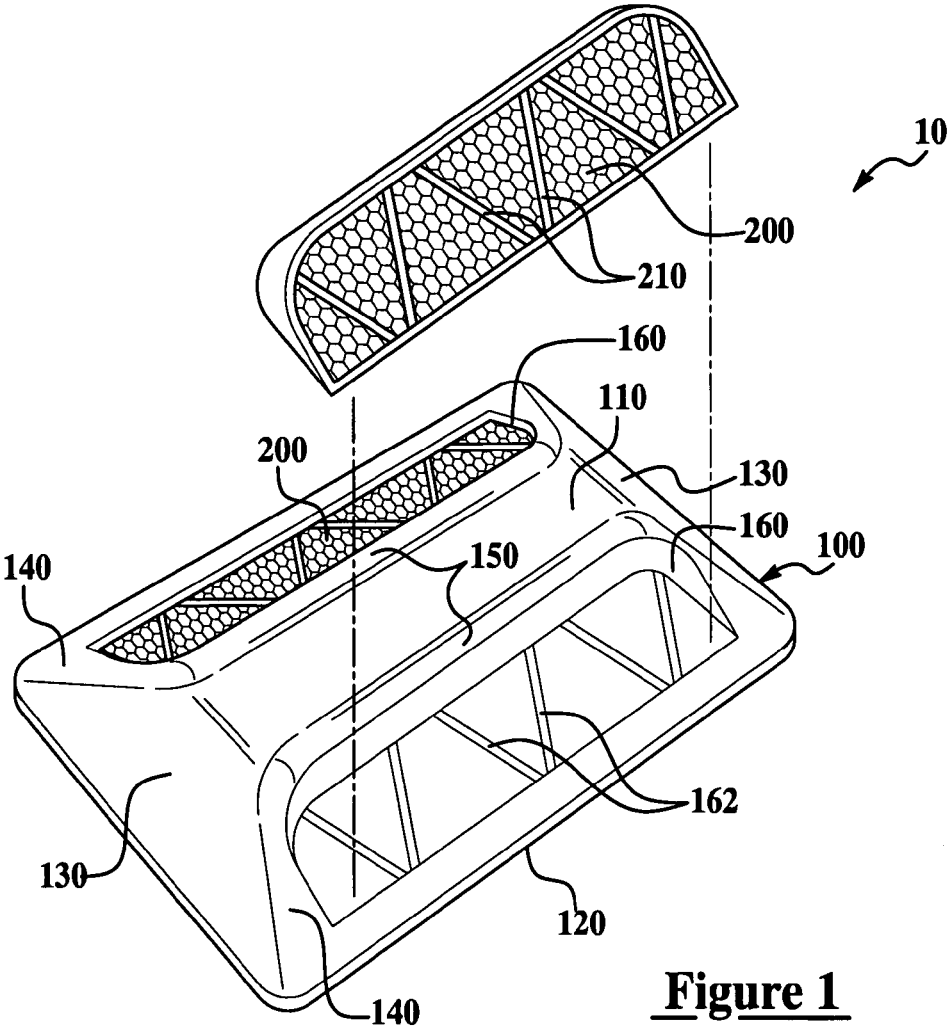
FIG. 1 shows a top exploded perspective view of a road marker in accordance with the present invention.

In accordance with the present invention, a road marker is shown generally at 10 in FIG. 1. The road marker 10 is comprised of a shell 100 with a top surface 110 and a bottom surface 120. The shell 100 also has at least one end surface 130 and at least one angled side surface 140. For illustrative purposes only, the end surface 130 shown in FIG. 1 is angled, i.e. the end surface 130 is not normal to the bottom surface 120. In the alternative, the end surface 130 is normal to the bottom surface 120. Rising slightly above top surface 110 is a brow 150. The brow 150 runs the length of recess 160 in order to prevent an automobile tire from contacting a retroreflective lens 200. The retroreflective lens 200 fits within the recess 160 in order to afford a reflective road marker.

The shell 100 is made from any rigid moldable material such as acrylic plastic or polyurethane and is manufactured as one piece. The retroreflective lens 200 is trapezoidal in shape. As shown in FIG. 1, the road marker of the present embodiment contains two retroreflective lenses 200. However, the road marker disclosed in the present invention can contain only one, or more than two retroreflective lenses 200. The retroreflective lens 200 has a smooth outer surface and cube corners formed on the interior surface. The cube corners may be metalized as is known in the industry to improve reflectivity.

Ribs 210 are formed to extend at an angle across the back of the retroreflective lens 200 in order to provide strength. In addition, ribs 210 physically contact beads 162 in complementary recess 160 when said lens 200 is placed within said recess 160. The physical contact between ribs 210 and beads 162 enhances the ultrasonic welding of said lens 200 to shell 100 when such method is used to permanently affix the lens to the shell. In addition to ultrasonic welding, retroreflective lens 200 is permanently affixed into complementary recess 160 of shell 100 using any satisfactory manner, illustratively including the use of adhesives.

Figure 2:
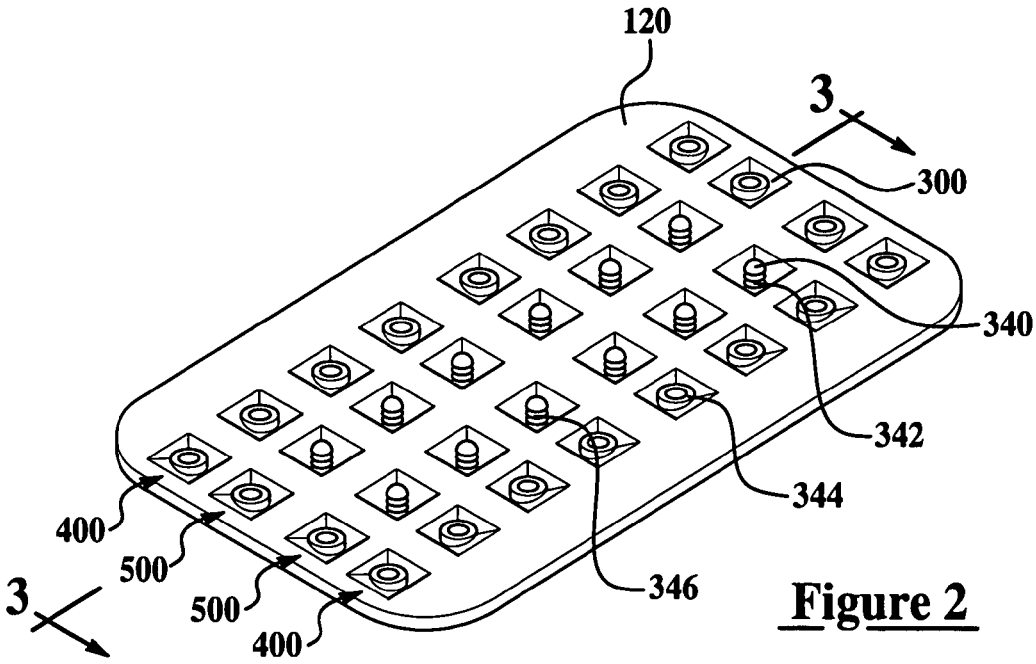
FIG. 2 shows a bottom perspective view of a first embodiment of the present invention.

A perspective view of the bottom of shell 100 for a first embodiment of the present invention is shown in FIG. 2. A series of recesses 300 extend from the bottom surface 120 into the interior of shell 100. The recesses 300 shown in FIG. 2 have a cross section in the shape of a square. In the alternative, the cross section of recesses 300 can be a circle, an ellipse, a triangle or any other polygon. Furthermore, the shape of the recesses can vary as a function of depth into the shell 100 and location on the bottom surface 120.

In general, the depth of a particular recess 300 is dependent on the location of said recess with respect to the shell bottom surface 120. For example, except for the recesses 300 closest to the edge of bottom surface 120, the depth of recesses 300 in the first set of rows 400 is less than the depth of recesses 300 in the second set of rows 500. This difference in depth among the recesses 300 is due rows 400 being closer in proximity to the edges of bottom surface 120.

The present invention affords a depth for the recesses 300 in the first set of rows 400 ranging from 0 to 75 percent of the thickness of the shell 100. For the purposes of the present invention, the thickness of the shell is defined as the normal distance between the top surface 110 and the bottom surface 120. More preferably, the depth of the recesses 300 in the first set of rows 400 ranges from 10 to 60 percent of the total thickness of shell 100. Even more preferred, the depth of the recesses 300 in the first set of rows 400 ranges from 15 to 55 percent of the total thickness of shell 100. Regarding the second set of rows 500, preferably the depth of the recesses 300 ranges from 30 to 90 percent of the thickness of the shell 100. More preferably, the depth of the recesses 300 in the second set of rows 500 ranges from 45 to 85 percent of the thickness of shell 100. Even more preferred, the depth of the recesses 300 in the second rows 500 ranges from 60 to 80 percent of the thickness of shell 100. Thus for a typical shell 100 having a thickness of 0.625 inches between the top surface 110 and bottom surface 120, recesses 300 in the first set of rows 400 have a depth ranging from 0.125 to 0.313 inches, and recesses 300 in the second set of rows 500, excluding the recesses 300 adjacent to the edge of bottom surface 120, have a depth ranging from 0.375 to 0.500 inches.

Within a recess 300, an elongated member 340 is located. In the alternative, a recess 300 does not have an elongated member 340 located therein. Elongated member 340 is comprised of a base 344 and a protrusion member 346. In the alternative, elongated member 340 consists of a protrusion member 346 with a base 344 not present. The protrusion member 346 has an undercut relief 342 thereon. The undercut relief 342 can be afforded as threads, ridges or any type of indentation on extension member 346 such that a rough surface results. The manufacture of the one piece shell 100 with the undercut relief 342 on elongated member 340 can be afforded using CUMSA Tulip and Double Ejector tooling from the PCS Company located at 34488 Doreka Drive, Fraser, Mich. 48026. The undercut relief 342 affords for improved adherence between shell 100 and any type of glue or adhesive used to attached the road marker 10 to a road surface. As shown in FIG. 2, the elongated members 340 extend in an axial direction normal to the bottom surface 120. In the alternative, the elongated members 340 extend in an axial direction not normal to the bottom surface 120. Also, the axial length of elongated members 340 varies as a function of the depth of recess 300 wherein said member is located.

Figure 3:
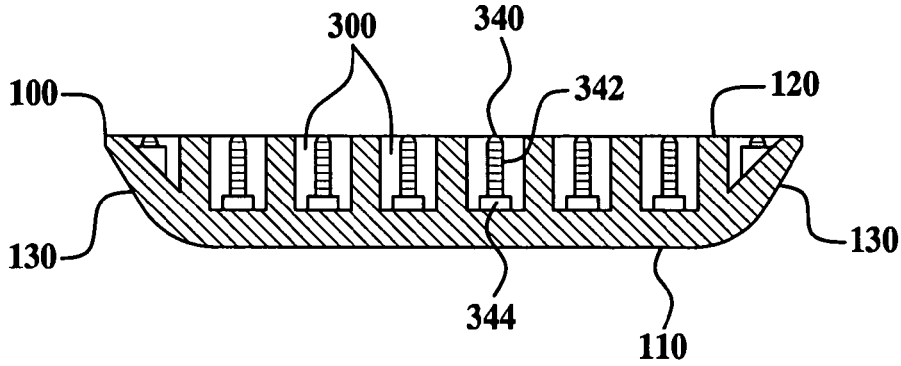
FIG. 3 shows a cross-sectional side view of a first embodiment of the present invention.

FIG. 3 shows a side view of the section AA shown in FIG. 2. The elongated members 340 extend to the bottom of recesses 300 where they are permanently affixed. The road marker shell 100 is manufactured in one piece, thereby affording a permanent attachment between the elongated members 340 and shell 100. FIG. 3 also illustrates how the depth of recesses 300 can vary as a function of location on the bottom surface 120.

Figure 4:
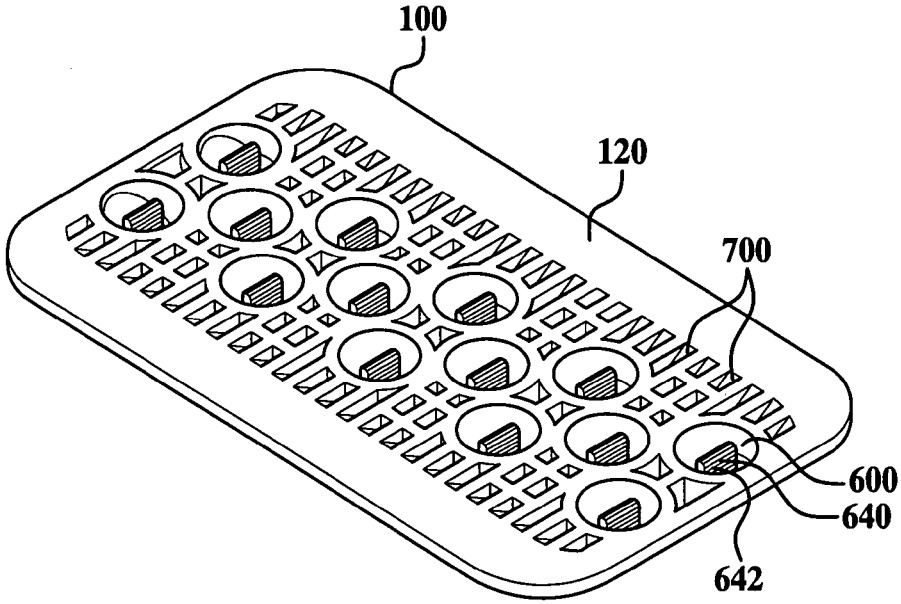
FIG. 4 shows a bottom perspective view of a second embodiment of the present invention.
Figure 5:
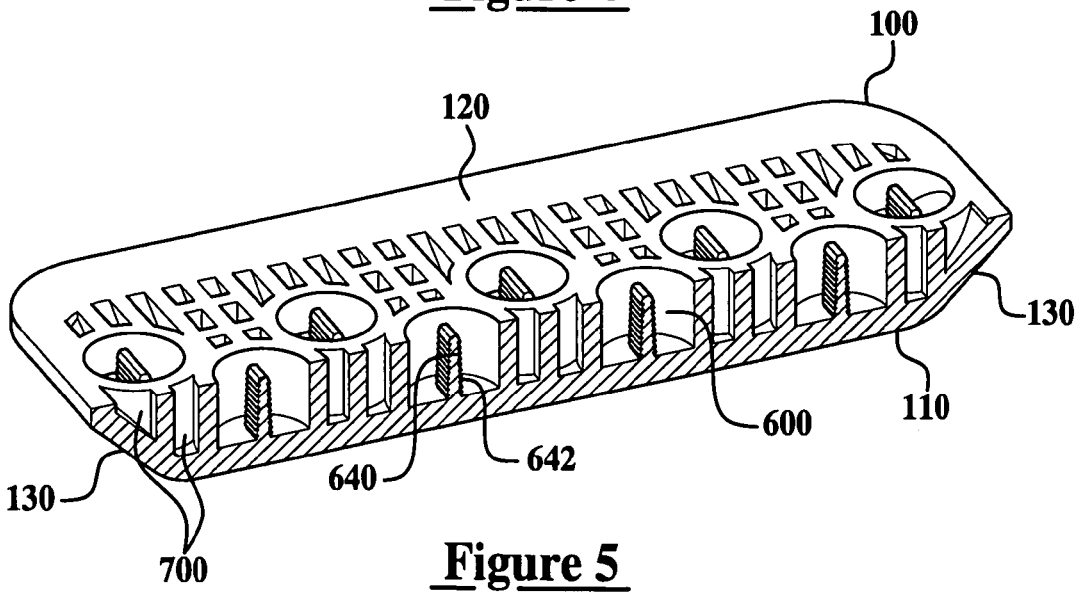
FIG. 5 shows a cross-sectional side view of a second embodiment of the present invention.

A second embodiment of the present invention is shown in FIGS. 4 and 5. FIG. 4 shows a bottom perspective view wherein elongated members 640 are within recesses 600. In addition to recesses 600, this embodiment affords for recesses 700 wherein no elongated member 640 is present. The shape of elongated member 640 is that of a Christmas tree wherein the undercut relief 642 in the form of ridges affords a rough surface. Also noted in FIG. 4 is the staggered set of rows of recesses 600. In the alternative, the rows of recesses 600 can be equally spaced such as those shown in FIGS. 2 and 3. Furthermore, the recesses 700 need not be present.

With the shell 100 having recesses 300 and/or recesses 600, any type of adhesive used to affix said shell to a highway surface is more effective due to the undercut relief 342 and/or 642 which accepts said adhesive for the purpose of holding the road marker onto a road. In this manner, an improved road marker shell manufactured in one piece is provided by the present invention.

The invention is not restricted to the illustrative examples described above. The examples are not intended as limitations on the scope of the invention. Methods, apparatus, compositions and the like described herein are exemplary and not intended as limitations on the scope of the invention. Changes therein and other uses will occur to those skilled in the art. The scope of the invention is defined by the scope of the claims.

The invention claimed is:

1. A road marker comprising:

a retroreflective lens;

a shell having a top surface and a bottom surface;

a plurality of first recesses extending inwardly from said bottom surface into said shell;

each of said plurality of first recesses including an elongated member extending therein;

each elongated member having an undercut relief;

at least one end surface between said top surface and said bottom surface; and at least one angled side surface between said top surface and said bottom surface, said at least one angled side surface having a second recess for housing said retroreflective lens.

2. The invention of claim 1 wherein said plurality of second recesses have a cross section selected from the group consisting of a circle, ellipse, square and polygon.

3. The invention of claim 1 wherein said elongated member has a cross section elected from the group consisting of a circle, ellipse, square and polygon.

4. The invention of claim 3 wherein said elongated member has a varying cross section along the axial direction.

5. The invention of claim 1 wherein said undercut relief is a threaded surface.

6. The invention of claim 1 wherein said undercut relief is a ridged surface.

7. The invention of claim 1 wherein said plurality of second recesses is comprised of a series of rows of recesses.

8. The invention of claim 7 wherein said series of rows is comprised of an outer set of rows and an inner set of rows.

9. The invention of claim 8 wherein said outer set of rows extends into said shell a distance ranging from 0 to 75 percent of said shell thickness.

10. The invention of claim 8 wherein said outer set of rows extends into said shell a distance ranging from 10 to 60 percent of said shell thickness.

11. The invention of claim 8 wherein said outer set of rows extends into said shell a distance ranging from 15 to 50 percent of said shell thickness.

12. The invention of claim 8 wherein said inner set of rows extends into said shell a distance ranging from 30 to 90 percent of said shell thickness.

13. The invention of claim 8 wherein said inner set of rows extends into said shell a distance ranging from 45 to 85 percent of said shell thickness.

14. The invention of claim 8 wherein said outer set of rows extends into said shell a distance ranging from 60 to 80 percent of said shell thickness.

* * * * *